US009386858B2

(12) United States Patent
Chen

(10) Patent No.: US 9,386,858 B2
(45) Date of Patent: Jul. 12, 2016

(54) STRUCTURE-IMPROVED MULTIFUNCTION CHASSIS

(76) Inventor: Yucheng Chen, Guangzhou (CN)

( * ) Notice: Subject to any disclaimer, the term of this patent is extended or adjusted under 35 U.S.C. 154(b) by 80 days.

(21) Appl. No.: 13/423,298

(22) Filed: Mar. 19, 2012

(65) Prior Publication Data

US 2015/0320217 A1 Nov. 12, 2015

(51) Int. Cl.
*A47C 3/20* (2006.01)
*A47C 1/023* (2006.01)
*A47C 1/024* (2006.01)

(52) U.S. Cl.
CPC . *A47C 3/20* (2013.01); *A47C 1/023* (2013.01); *A47C 1/024* (2013.01)

(58) Field of Classification Search
USPC ..... 297/463.1, 300.3, 301.2, 302.2; 74/501.6
See application file for complete search history.

(56) References Cited

U.S. PATENT DOCUMENTS 5,630,647 A * 5/1997 Heidmann ..... A47C 1/023 297/303.1
6,045,187 A * 4/2000 Stumpf ..... A47C 3/30 297/300.3
6,116,695 A * 9/2000 Heidmann ..... A47C 1/023 297/285
6,325,456 B1 * 12/2001 Carnahan ..... A47C 3/18 297/344.24
6,874,853 B2 * 4/2005 Wild ..... A47C 1/03255 297/300.1
7,165,810 B2 * 1/2007 McMillen ..... B60N 2/66 297/284.4
7,182,402 B1 * 2/2007 Ahad ..... B60N 2/22 297/354.12
7,293,832 B2 * 11/2007 Huang ..... A47C 1/03238 297/300.7
7,410,216 B2 * 8/2008 Rutman ..... A47C 1/03255 297/300.1
7,607,368 B2 * 10/2009 Takahashi ..... B62K 5/01 180/336
2007/0228801 A1 * 10/2007 Matern ..... A47C 1/03233 297/463.1
2010/0251847 A1 * 10/2010 Gordy ..... F16C 1/14 74/502.6
2012/0280556 A1 * 11/2012 Colboch ..... F16C 1/26 297/85 C
2013/0069408 A1 * 3/2013 Chen ..... A47C 1/03205 297/337
2014/0084664 A1 * 3/2014 Archambault ..... B60N 2/146 297/463.1
2014/0125104 A1 * 5/2014 Hasegawa ..... A47C 1/023 297/303.4

* cited by examiner

*Primary Examiner* — Timothy J Brindley

(57) ABSTRACT

A structure-improved multifunction chassis includes a chassis base, a handle and a plurality of pull lines, wherein the chassis base includes a backrest angle adjustment device, a cushion height adjustment device, and a cushion back-and-forth moving device. The chassis base is pivotally connected with a left and right connecting rod of a seat backrest frame. The handle includes a shift arm, a handle fixed block, and a handle base. The handle fixing block is installed in the handle base and is able to swing up and down. The handle fixing block is mounted on the handle base by bolts. One handle controls three pull lines at the same time, and the user adjusts the angle of the backrest, cushion lifting or moving back and forth by operating the handle.

7 Claims, 6 Drawing Sheets

STRUCTURE-IMPROVED MULTIFUNCTION CHASSIS

FIELD OF THE INVENTION

The present invention relates to a seat, and more specifically to a structure-improved multifunction chassis, including one handle with three pull lines to adjust the angle of the backrest, the height of the cushion and the back and forth movement of the cushion.

BACKGROUND OF THE INVENTION

A seat is an important equipment in people's daily life and work life. In order to make the seat more comfortable and convenient, many different kinds of adjustable seats are designed by people, such as folding seat, height-adjustable swivel seat, adjustable backrest tilt angle seat.

The existing multifunction seat generally is composed of the chassis, a handle, a backrest, a headrest and a cushion. Pursuing humanized work design, the chassis and the handle need to have multifunction operating structures. The backrest and the headrest are able to swing back and forth, and the cushion is able to slide back and forth so as to meet the expectations of comfort and ergonomic. In the existing design of seats, a plurality of handles are installed on both sides of the seat, but one handle has only one function. For example, one handle controls the height of the cushion, the other handle controls the backrest and the headrest to swing back and forth, yet another handle controls the cushion to slide back and forth. Obviously, there are so many handles that people feel more cumbersome when they use them. In addition, due to the limited space of the chassis, the structure of the multifunction chassis is usually bulky and heavy weight. Those control rods with various adjustment function are outwardly projecting. Not only much energy is wasted to move the seat, but also the appearance of the seat is ugly and the seat is difficult to operate. Therefore, a new structure of a seat has been proposed. The chassis is pivoted with the seat backrest frame, and then the seat backrest frame is pivoted by a sliding rod, so the backrest frame is able to swing relative to the chassis. The sliding rod is controlled by springs, which are controlled by an adjusting wheel. The slide block is mounted on the seat frame, and the movement of the cushion and the tilt angle of the backrest are controlled by a screw. For this kind of chassis, there still are some disadvantages, For example, the structure is complex and not easy to operate and the size is too big.

It is necessary to provide an improved adjustable seat to alleviate these defects.

SUMMARY OF THE INVENTION

In order to overcome the disadvantages of the prior art, the present invention provides a multifunction chassis that has a simple structure and is easy to operate. Only one handle of the seat is used to control backrest angle adjustment, the cushion height adjustment and the back and forth movement of the cushion.

A structure-improved multifunction chassis, including a chassis base, a handle and a plurality of pull lines, wherein, the chassis base includes a backrest angle adjustment device, a cushion height adjustment device, and a cushion back-and-forth moving device, the chassis base is pivoted with a left and right connecting rod of a seat backrest frame; the handle includes a shift arm, a handle fixing block, and a handle base; the handle fixing block is installed in the handle base and is swingable up and down, the handle fixing block is mounted on the handle base by bolts; a plurality of pull line positioning grooves formed on one end of the handle base and comprises a first pull line positioning groove, a second pull line positioning groove, and a third pull line positioning groove; the shift arm is installed in the handle fixing block is swingable from side to side; the pull lines includes a first pull line located in the first pull line positioning groove, a second pull line located in the second pull line positioning groove, and a third pull line located in the third pull line positioning groove, the shift arm and the backrest angle adjustment device are linked by the first pull line; the shift arm and the cushion height adjustment device are linked by the second pull line; the shift arm and the back-and-forth moving device are linked by the third pull line.

A structure-improved multifunction chassis, wherein the backrest angel adjustment device includes a back fixing strip and a backward pull line fixing block, the back fixing strip defines a first slot, the backward pull line fixing block defines a second slot, the first pull line passes through the first slot and the second slot.

A structure-improved multifunction chassis, wherein the cushion height adjustment device includes a shift member, a rotatable handle, a gas strut and a pull line fixing block, the shift member defines a third slot, and the pull line fixing block of defines a fourth slot, and the second pull line passes through the third slot and the fourth slot for connecting the gas strut.

A structure-improved multifunction chassis, wherein a gas strut height adjustment switch disposes on one side of the gas strut and connected with the second pull line.

A structure-improved multifunction chassis, wherein the cushion back-and-forth moving device includes a slide pedestal and a slide position control device for the slide pedestal which comprises a slide pedestal fixing base, a slide pedestal slide positioning block and a slide pedestal and a positioning spring, and wherein the slide pedestal, comprises a bracket and a base, the third pull line passes through a fifth slot formed in the slide pedestal slide positioning block.

A structure-improved multifunction chassis, further including a rotating shaft, a first spring and a spring rotating base, the spring rotating base defines a sliding groove and has an axis, the spring is coiled around the rotating shaft in a ring manner and is positioned in the spring rotating base, and the two ends of the rotating shaft are fixedly connected with a left and right connecting rod of the seat backrest frame; first and second racks are provided in the chases base and meshed with each other; wherein one end of one first rack is positioned in the sliding groove, and another end thereof presses against a second spring; the second rack slides in the chassis base so as to be meshed with or separated from the rack, and is connected with the shift arm by the first pulling line; one exposed head of the second spring presses against a cavity wall of the spring rotating base, and another exposed head thereof presses against a slide block which moves up and down; the slide block is threadably connected with a screw; and a top part of the screw is provided with a turntable which is connected with one end of a rotatable handle by bevels.

A structure-improved multifunction chassis, wherein two first springs are coiled around the rotating shaft in a ring manner symmetrically.

A structure-improved multifunction chassis, wherein two ends of the chassis base are pivotally connected with the left and right connecting rod of the seat backrest frame respectively, the slide pedestal is located above the left and right connecting rod of the seat backrest frame.

Through the combination of the above components, the shift arm connects with the backrest angle adjustment device, the cushion height adjustment device and the cushion back-and-forth moving device respectively. So when the user rotates the shift arm upward according to the instructions of directional signs, the second pull line lead the cushion height adjustment device to move up and the cushion goes up. The second pull line will be locked when the user stops rotating the shift arm, and the cushion keeps at a certain height. When the shift arm is pressed downward, the second pull line leads the cushion height adjustment device to move down and the cushion goes down. The second pull line will be locked if the user stops pressing the shift arm. When the user needs to adjust the tilt angle of the backrest of the seat, he can pull the shift arm backward to make the rack move by the first pull line, then the racks will be driven apart to achieve a backward rotation of the backrest. Meanwhile, the rotating shaft will also rotate, leading to a rotation of the spring rotating base. One side wall of the sliding groove will press against the top part of the rack, making it move longitudinally. When the backrest rotates to the desired angle, the user releases the shift arm, and the spring of the fixed block pushes against the rack horizontally. The two racks will be meshed with each other, making the racks fixed at a specific position. If the user moves the shift arm forward, the third pull line will cause the cushion to slide. Therefore, the handle of this present invention is able to control three pull lines at the same time, and the operation is very simple and clear. All of the pull lines are controlled by the same handle, conforming to the user's operating habits, and so it is very easy to use. Everyone can adjust the seat while sitting on it. And all of the installation, separation and maintenance of the chassis become easy.

DETAILED DESCRIPTION OF THE INVENTION

Figure 1:
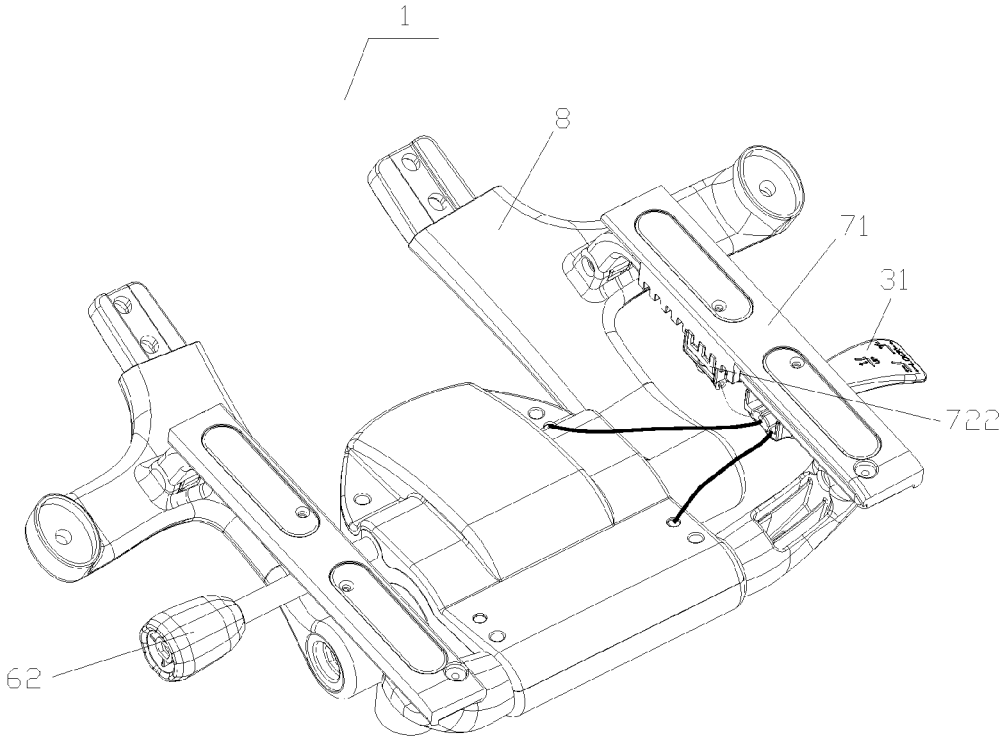
FIG. 1 is a schematic diagram of the multifunction chassis in accordance with the present invention.
Figure 2:
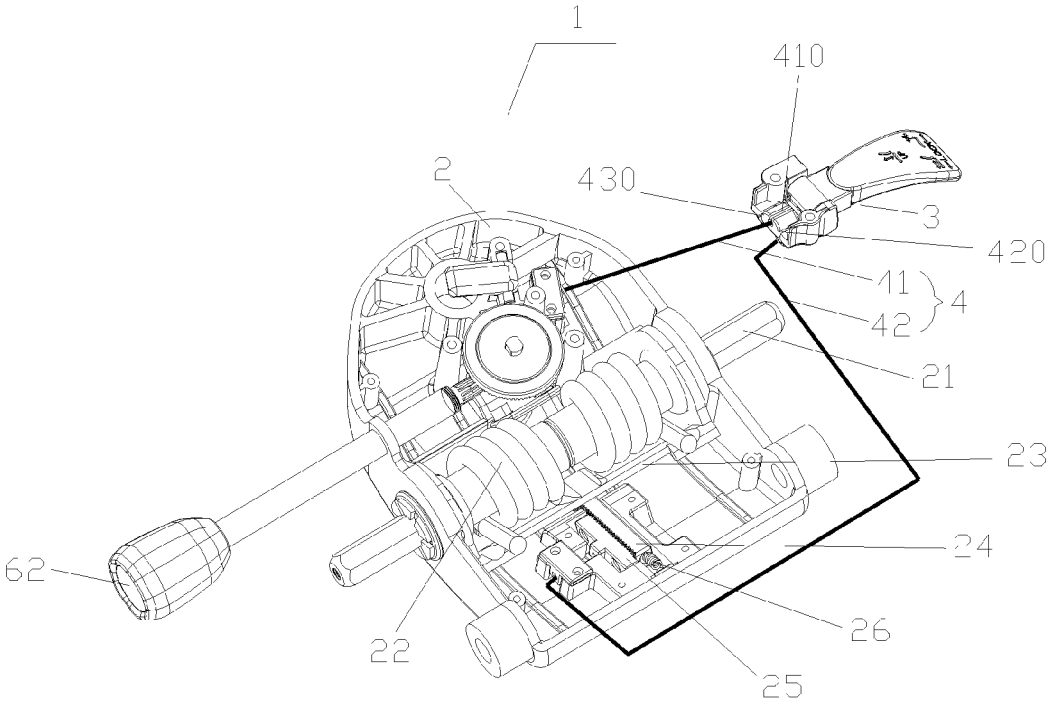
FIG. 2 is a schematic diagram of an exploded view of the multifunction chassis 125 of FIG. 1 in accordance with the present invention.
Figure 3:
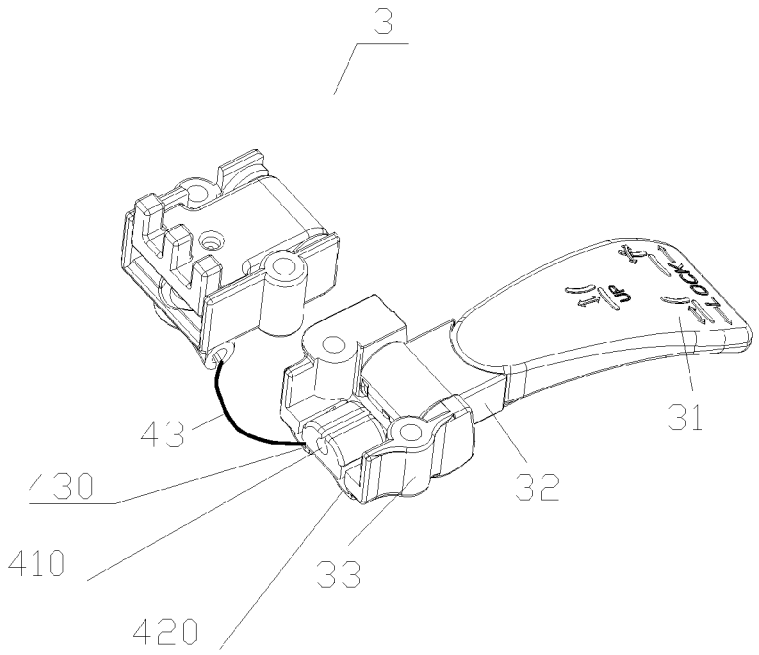
FIG. 3 is a structural diagram of the handle of FIG. 1 in accordance with the present invention.

The following illustrations are further explanations of the invention, with the instructions of the figures.

Referring to FIGS. 1-9, a structure-improved multifunctional chassis 1 includes a chassis base 2, a handle 3 and a plurality of pull lines 4. As used herein, the term "pull line" means a length of cord, rope, wire or other material serving the purpose of pulling an object. The chassis base 2 includes a backrest angle-adjustment device 5, a cushion lift adjustment device 6 and a cushion back-and-forth moving device 7. The chassis base 2 is fixedly connected with a left and right connecting rod of the seat backrest frame 8. The handle 3 comprises a shift arm 31, a handle fixing block 32 and a handle base 33. The handle fixing block 32 is installed on the handle base 33, which is able to swing up and down. The handle fixing block 32 and the handle base 33 are connected by bolts 34. The user can adjust the seat purposefully according to the directional signs (not shown) on the shift arm 31. A plurality of pull line positioning grooves 410, 420, 430 is formed on one end of the handle base 33, including a first pull line positioning groove 410, a second pull line positioning groove 420 and a third pull line positioning groove 430. The shift arm 31 is installed in the handle fixing block 32, and is able to swing from side to side. The pull lines 4 include a first pull line 41, a second pull line 42 and a third pull line 43. The shift arm 31 and the backrest angle adjustment device 5 are linked by the first pull line 41, which is located in the first pull line positioning groove 410; the shift arm 31 and the cushion height adjustment device 6 are linked by the second pull line 42, which is located in the second pull line positioning groove 420; the shift arm 31 and the cushion back-and-forth moving device 7 are linked by the third pull line 43, which is located in the third pull line positioning groove 430.

Figure 10:
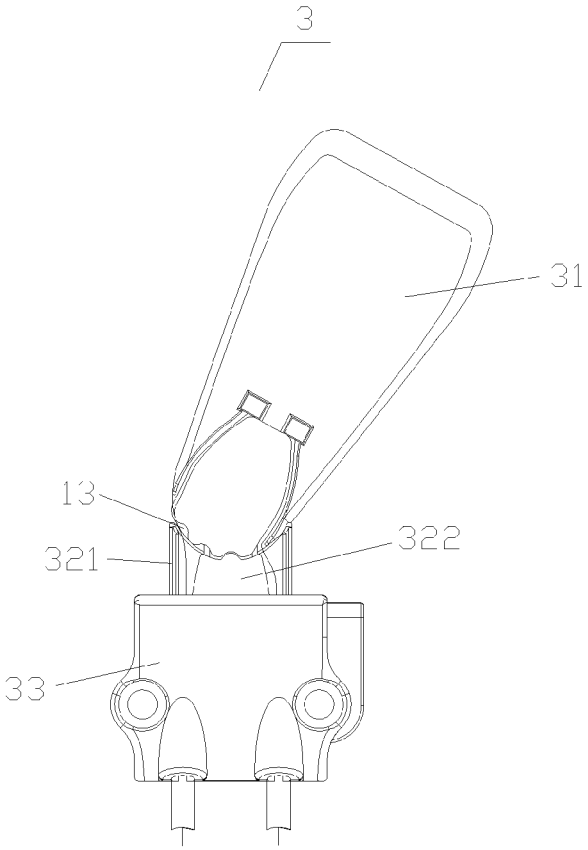
FIG. 10 is a schematic diagram of the positioning of the handle of FIG. 1 in accordance with the present invention.

As shown in FIG. 10, at the edge of the joint of the shift arm 31 and the handle fixing block 32, there are a plurality of arc-shaped openings 13, and two sides of the handle fixing block 32 have two protruding abutment blocks 321 respectively, and in the middle of which there is an extension block 322. When the handle fixing block 32 is connected to the shift arm 31, the extension block 322 will insert into the shift arm 31, and the protruding abutment blocks 321 will abut against two sides of the shift arm 31 respectively. When the user turns the shift arm to the left or right and the protruding abutment blocks 321 abut against the opening 13, then the shift arm 31 is fixed at a position. Similarly, when the user turns the shift arm 31 up or down, the extension block 322 will be pulled out from the shift arm 31. When the extension block 322 abuts against the edge of the opening 13, then the shift arm 31 is fixed at a positioned.

Figure 6:
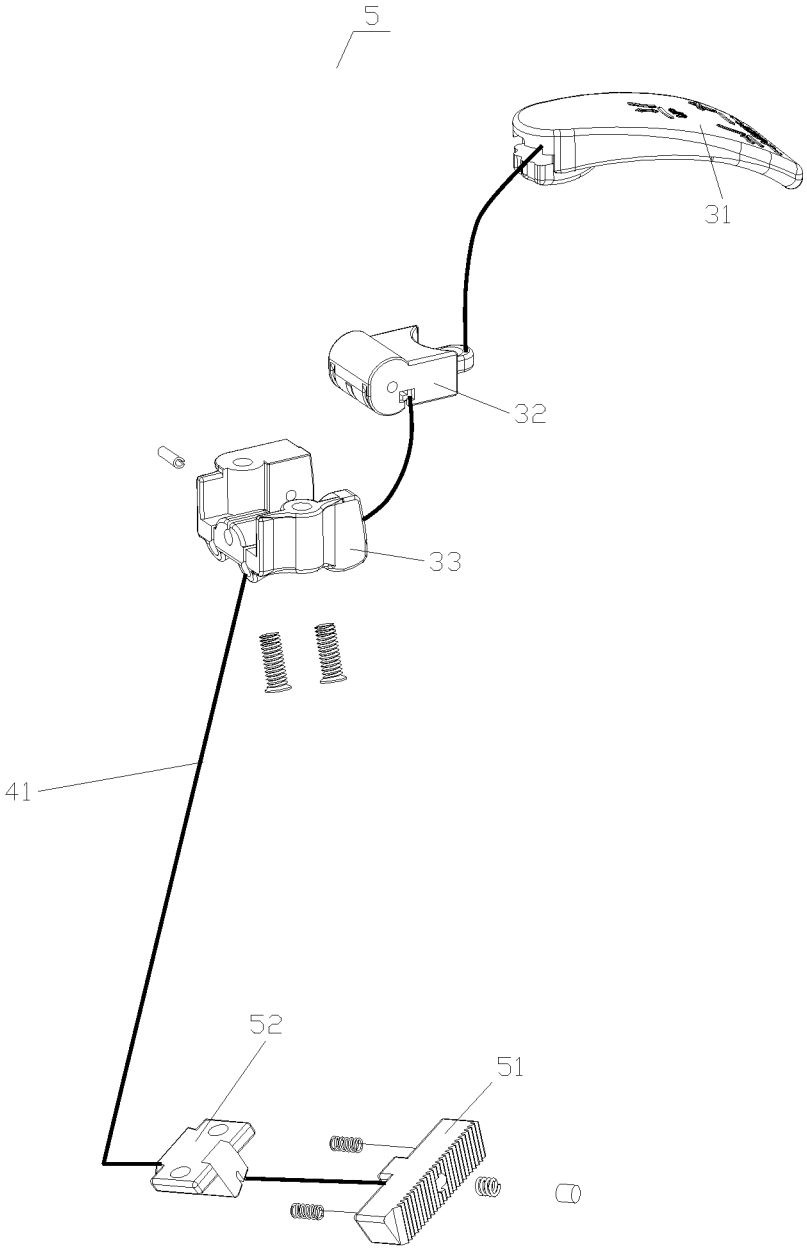
FIG. 6 is a structural diagram of the backrest angle adjustment device of FIG. 1 in accordance with the present invention.

As shown in FIG. 6, the structure-improved multifunction chassis 1 is provided with the backrest angle adjustment device 5 which includes a back fixed strip 51 and a backward pull line fixed block 52. The back fixing strip 51 defines a first slot 511, and the backward pull line fixing block 52 defines a second slot 521. The first pull line 41 passes through the first slot 511 and the second slot 521.

Figure 5:
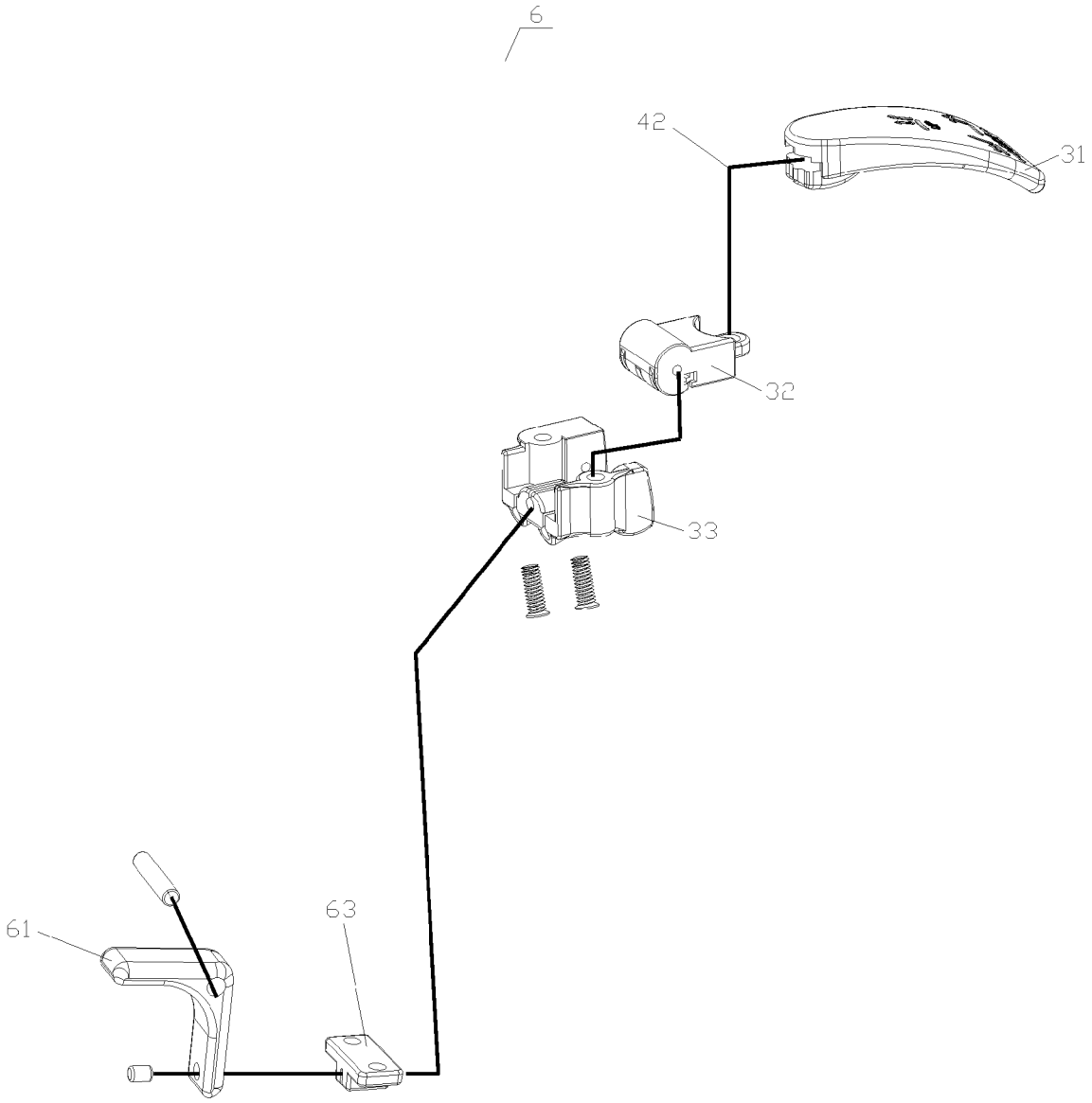
FIG. 5 is a structural diagram of the cushion lift adjustment device of FIG. 1 in accordance with the present invention.
Figure 7:
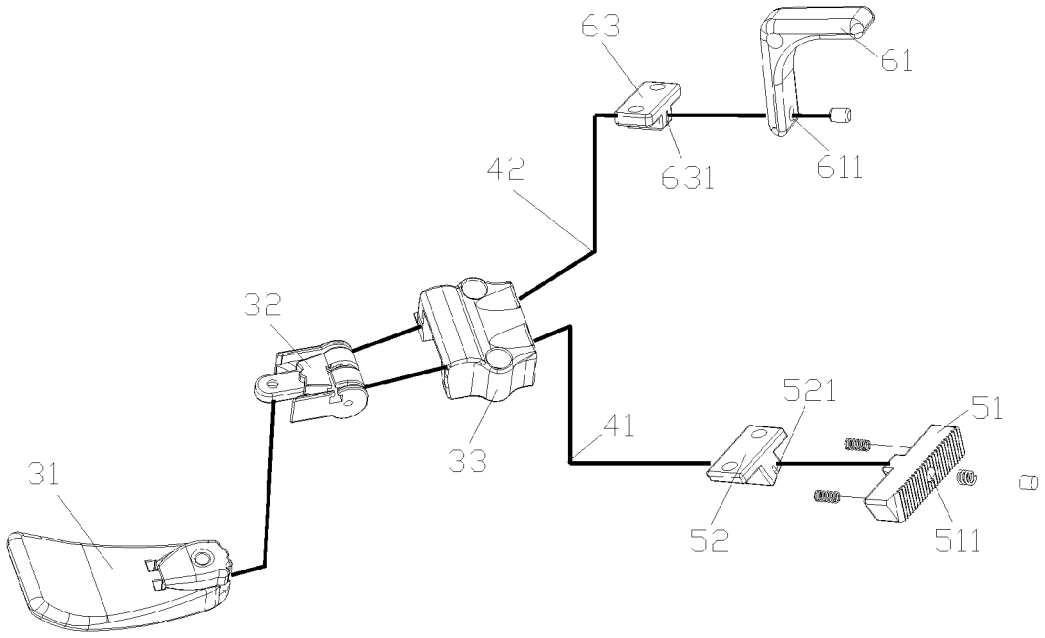
FIG. 7 is a structural diagram of parts of the chassis base of FIG. 1 in accordance with the present invention.
Figure 8:
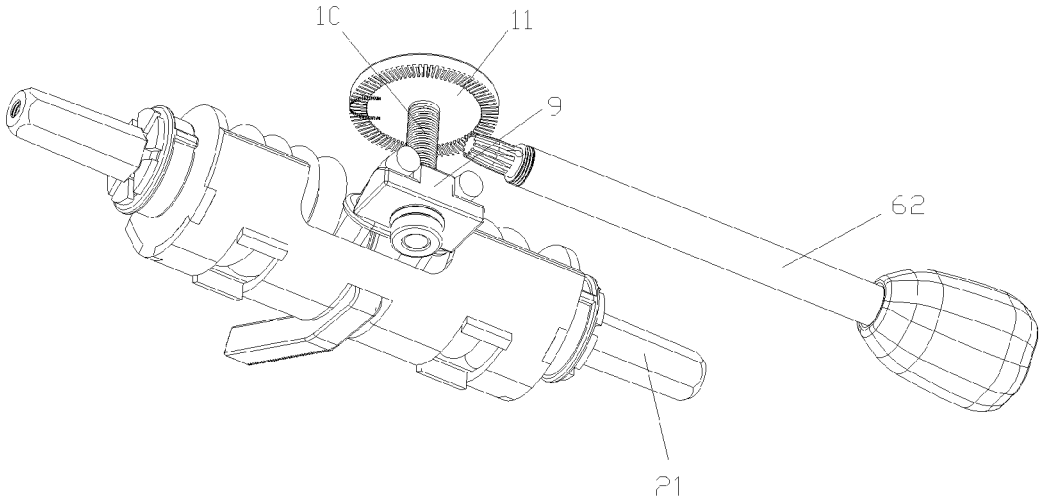
FIG. 8 is a schematic diagram of parts of the chassis of FIG. 1 in accordance with the present invention.

As shown in FIG. 5 and FIG. 7, the structure-improved multifunction chassis 1 is provided by the cushion height adjustment device 6 which includes a shift member 61, a rotatable handle 62, a gas strut (not shown) and the shift member pull line fixing block 63. The shift member 61 defines a third slot 611, and the shift member pull line fixing block 63 defines a fourth slot 631, The second pull line 42 passes through the third slot 611 and the fourth slot 631 for connecting the gas strut (not shown). The gas strut height adjustment switch (not shown) disposes on one side of the gas strut and connects the second pull line 42.

Figure 4:
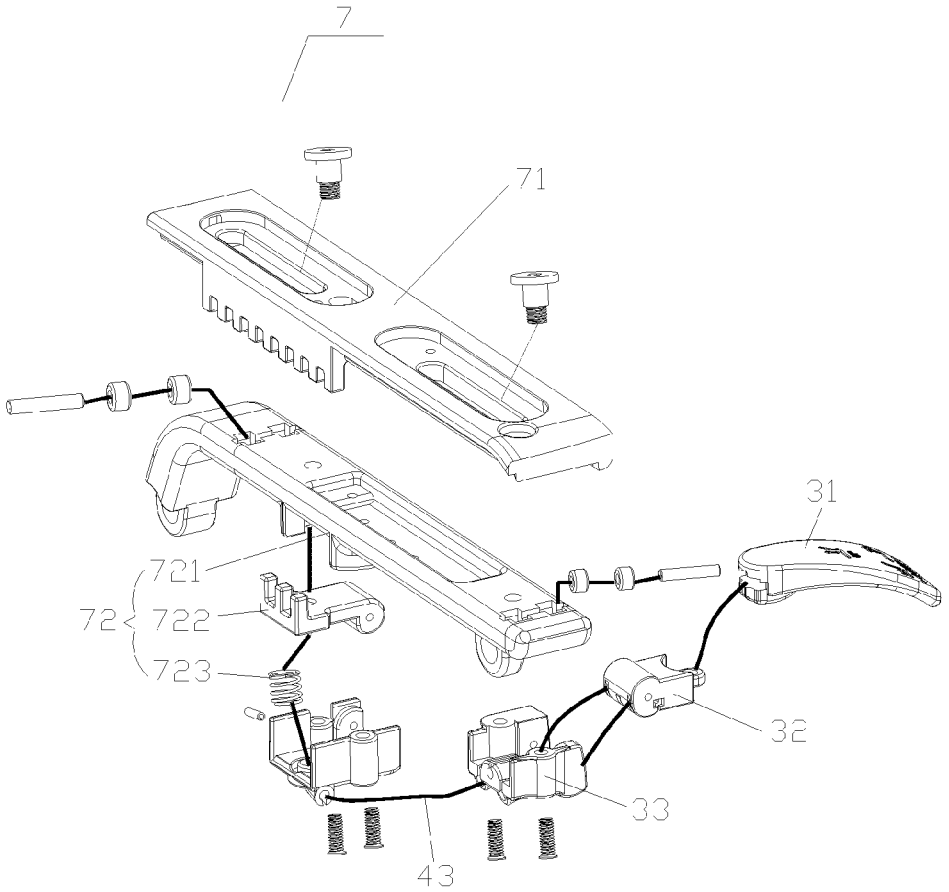
FIG. 4 is a structural diagram of the cushion back-and-forth moving device of FIG. 1 in accordance with the present invention.
Figure 9:
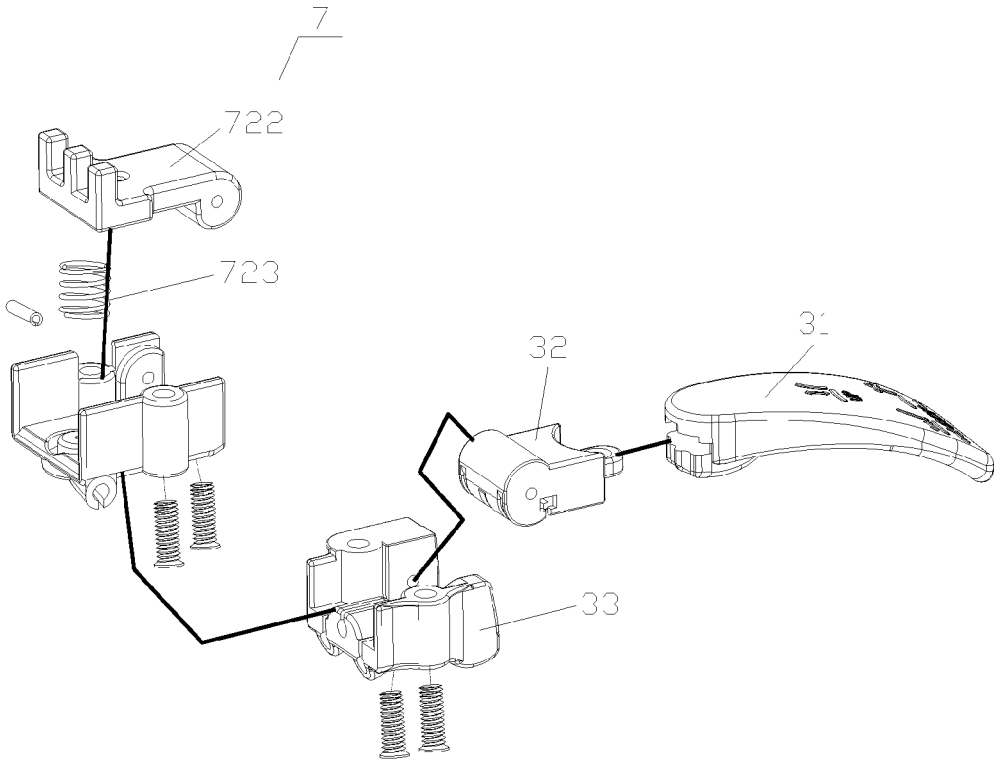
FIG. 9 is a structural diagram of the cushion back-and-forth moving device of FIG. 1 in accordance with the present invention.

In FIG. 4 and FIG. 9, the structure-improved multifunction chassis 1 is provided with the cushion back-and-forth moving device 7 includes a slide pedestal 71 and a slide position control device 72 for the slide pedestal 71. The slide position control device 72 includes a fixed base 721 for the slide pedestal 71, and a slide positioning block 722 for the slide pedestal 71 and a positioning spring 723 for the slide pedestal 71. The slide pedestal 71 includes a bracket (not shown) and a base (not shown). The third pull line 43 passes through a fifth slot formed in the slide positioning block 722 for the slide pedestal 71. The chassis base 2 further includes a slide frame (not shown). The slide pedestal 71 is able to move back and forth by the slide frame (not shown) relative to the bracket.

Preferred, the structure-improved multifunction chassis 1 further includes a rotating shaft 21, a first spring 22 and a spring rotating base 23. The spring rotating base 23 defines a sliding groove (not shown) and has an axis (not shown. The spring 22 is coiled around the rotating shaft 21 in a ring manner and is positioned in the spring rotating base 23. Two ends of the rotating shaft 21 are fixedly connected with a left and right connecting rod of the seat backrest frame 8. There are first and second racks 24, 25 in the chassis base 2 which can be meshed with each other. One end of one first rack 24 is positioned in the sliding groove (not shown), and the other end thereof presses against a second spring 26. The second rack 25 is able to slide in the chassis base 2 so as to be meshed with or separated from the rack 24, and is connected with the shift arm 31 by the first pulling line 41. One exposed head of the second spring 26 presses against a cavity wall of the spring rotating base 23, and the other exposed head thereof presses against a slide block 9 which moves up and down. The slide block 9 is threadably connected with a screw 10, and a top part of the screw 10 is provided with a turntable 11 which is connected with one end of the roatable handle 62 by bevel gears.

The structure-improved multifunction chassis 1 is provided with tow first springs 22 coiled around the rotating shaft 21 in a ring manner symmetrically.

Preferred, two ends of the chassis base 2 are pivoted connected with the left and right connecting rod of the seat backrest frame 8 respectively. The slide pedestal 71 is located above the left and right connecting rod of the seat backrest frame 8.

The shift arm 31 connects with the backrest angle adjustment device 5, the cushion height adjustment device 6 and the cushion back-and-forth moving device 7 respectively. So when the user rotates the shift arm 31 upward according to the instructions of directional signs, the second pull line 42 leads the cushion height adjustment device 6 to move up and the cushion goes up. The second pull line 42 will be locked when the user stops rotating the shift arm 31, and the cushion keeps at a certain height. When the shift arm 31 is pressed downward, the second pull line 42 leads the cushion height adjustment device 6 to move down and the cushion goes down. The second pull line 42 will be locked if the user stops pressing the shift arm 31. When the user needs to adjust the tilt angle of the backrest of the seat, he can pull the shift arm 31 backward to make the rack 25 move by the first pull line 41, then the racks 24, 25 will be driven apart to achieve a backward rotation of the backrest. Meanwhile, the rotating shaft 21 will also rotate, leading to a rotation of the spring rotating base 23. One side wall of the sliding groove will press against the top part of the rack, making it move longitudinally. When the backrest rotates to the desired angle, the user releases the shift arm 21, and the spring of the fixed block pushes against the rack horizontally. The two racks will be mesh with each other, making the longitudinal rack fixed at a specific position. If the user moves the shift arm 31 forward, the third pull line 43 will cause the cushion to slide. Therefore, the handle of this present invention is able to control three pull lines at the same time, and the operation is very simple and clear. All of the pull lines are controlled by the same handle, conforming to the user's operating habits, so it is very easy to use. Everyone can adjust the seat while sitting on it. And all of the installation, separation and maintenance of the chassis become easy.

When the user needs to adjust the tilt angle of the backrest of the seat, the user can pull the shift arm 31, and the shift arm 31 pulls the rack which connects with the shift arm 31 by the pull lines, and the two meshed racks will be separated from each other. Therefore, the backrest is able to move back and forth under the condition of the spring-rotating base 23 which pulls the rack connected with the spring-rotating base 23. When the backrest move to the desired position, the user releases the shift arm. The rack which is connected with the shift arm 31 meshes with another rack which is connected with the spring rotating base 23 under the pressure of the spring, making the backrest rotate to a certain angle. The control system of the tilt angle of the backrest has the advantages of simple structure, convenient operation, small size and light weight. The springs in the spring rotating base are able to make the backrest of the seat back to its original state when the user leaves the seat. Not only space is saved, but also the seat is in conformity with ergonomics. The elastic force of the springs can be adjusted by the handle to make the seat meet the needs of different people. The shift arm connected with the rack is installed in the handle base, and the shift arm is able to swing up and down. The user adjusts the angle of the backrest, cushion lifting or moving back and forth by operating the handle. It not only achieves convenient operation, but also meets the habits of the people's daily operation.

In addition, when the user needs to adjust the cushion height, the user rotates the shift arm 31 upward according to the instructive mark. The second pull line 42 drives the shift member 61, the pull line fixed block 63 of shift member 61 and the gas strut to move downward, thereby the gas strut height adjustment switch is pressed and leads the cushion height adjustment device 6 to move upward and the cushion rises. The second pull line 42 will be locked while the user stops rotating the shift arm 31, and the cushion is fixed at that height. When the user presses the shift arm 31, the second pull line 42 drives the shift member 61, the pull line fixing block 63 of shift member 61 and the gas strut to move downward, thereby the gas strut height adjustment switch is pressed and leads the cushion height adjustment device 6 to move downward, making the cushion back to the original height, or even making the cushion moves downward. The second pull line will be locked while the user stops pressing the shift arm 31.

When the user needs that the cushion moves backward and forward, the slide pedestal 71 moves back and forth by the slide frame relative to the bracket. When the user moves the cushion forward, the third pull line 43 drives the slide pedestal slide positioning block 722 to slide and separate from the slide pedestal fixed base 721, thereby the position control device leads the cushion to move back and forth. When it moves to a desired position, the user releases the shift arm 31, the slide positioning block 722 rivets the fixed base 721 under the elastic force of the slide positioning spring, thereby limiting the cushion to continue to move forward and backward.

The multifunction chassis of the present invention, when compared with the exiting chassis, has the following advantages.

One handle can control three pull lines at the same time, and the user adjusts the angle of the backrest, cushion lifting or moving back and forth by operating the handle. It not only can achieve convenient operation, but also meet the habits of the people's daily operation. Everyone can adjust the seat while sitting on it.

It should be noted that, the present invention is mainly in accordance of a structure-improved multifunction chassis suitable for different size and shape of chassis. Any structure and mounting method relates to this invention is within the scope of protection of the present invention. While the present invention has been illustrated by the above description of the preferred embodiments thereof, and the preferred embodiments have been described in considerable detail, it is not intended to restrict or in any way limit the scope of the appended claims to such details. Other advantages and modifications within the spirit and scope of the present invention will be readily apparent to those skilled in the art. Therefore, the present invention is not limited to the specific details and the illustrative examples shown and described.

What is claimed is:

1. A structure-improved multifunction chassis, comprising a chassis base, a handle, and a plurality of pull lines, wherein:

the chassis base comprises a backrest angle adjustment device, a cushion height adjustment device, and a cushion back-and-forth moving device, the chassis base is pivoted with a left and right connecting rod of a seat backrest frame;

the handle comprises a shift arm, a handle fixing block, and a handle base; the handle fixing block is installed in the handle base and is swingable up and down, the handle fixing block is mounted on the handle base by bolts; a plurality of pull line positioning grooves are formed on one end of the handle base and comprise a first pull line positioning groove, a second pull line positioning groove, and a third pull line positioning groove; the shift arm is installed in the handle fixing block and is swingable from side to side;

the pull lines comprise a first pull line located in the first pull line positioning groove, a second pull line located in the second pull line positioning groove, and a third pull line located in the third pull line positioning groove, the shift arm and the backrest angle adjustment device are linked by the first pull line; the shift arm and the cushion height adjustment device are linked by the second pull line; the shift arm and the cushion back-and-forth moving device are linked by the third pull line;

where the backrest angle adjustment device comprises a back fixing strip and a backward pull line fixing block, the back fixing strip defines a first slot, the backward pull line fixing block defines a second slot, the first pull line passes through the first slot and the second slot.

2. A structure-improved multifunction chassis, comprising a chassis base, a handle, and a plurality of pull lines, wherein:

the chassis base comprises a backrest angle adjustment device, a cushion height adjustment device, and a cushion back-and-forth moving device, the chassis base is pivoted with a left and right connecting rod of a seat backrest frame;

the handle comprises a shift arm, a handle fixing block, and a handle base; the handle fixing block is installed in the handle base and is swingable up and down, the handle fixing block is mounted on the handle base by bolts; a plurality of pull line positioning grooves are formed on one end of the handle base and comprise a first pull line positioning groove, a second pull line positioning groove, and a third pull line positioning groove; the shift arm is installed in the handle fixing block and is swingable from side to side;

the pull lines comprise a first pull line located in the first pull line positioning groove, a second pull line located in the second pull line positioning groove, and a third pull line located in the third pull line positioning groove, the shift arm and the backrest angle adjustment device are linked by the first pull line; the shift arm and the cushion height adjustment device are linked by the second pull line; the shift arm and the cushion back-and-forth moving device are linked by the third pull line;

wherein the cushion height adjustment device comprises a shift member, a rotatable handle, a gas strut and a pull line fixing block, the shift member defines a third slot, and the pull line fixing block defines a fourth slot, and the second pull line passes through the third slot and the fourth slot for connecting the gas strut.

3. The structure-improved multifunction chassis of claim 2, wherein a gas strut height adjustment switch is disposed on one side of the gas strut and connected with the second pull line.

4. The structure-improved multifunction chassis of claim 2, wherein the cushion back-and-forth moving device comprises a slide pedestal and a slide position control device for the slide pedestal which comprises a slide pedestal fixing base, a slide pedestal slide positioning block and a slide pedestal positioning spring, and wherein the slide pedestal comprises a bracket and a base, the third pull line passes through a fifth slot formed in the slide pedestal slide positioning block.

5. A structure-improved multifunction chassis, comprising a chassis base, a handle, and a plurality of pull lines, wherein:

the chassis base comprises a backrest angle adjustment device, a cushion height adjustment device, and a cushion back-and-forth moving device, the chassis base is pivoted with a left and right connecting rod of a seat backrest frame;

the handle comprises a shift arm, a handle fixing block, and a handle base; the handle fixing block is installed in the handle base and is swingable up and down, the handle fixing block is mounted on the handle base by bolts; a plurality of pull line positioning grooves are formed on one end of the handle base and comprise a first pull line positioning groove, a second pull line positioning groove, and a third pull line positioning groove; the shift arm is installed in the handle fixing block and is swingable from side to side;

the pull lines comprise a first pull line located in the first pull line positioning groove, a second pull line located in the second pull line positioning groove, and a third pull line located in the third pull line positioning groove, the shift arm and the backrest angle adjustment device are linked by the first pull line; the shift arm and the cushion height adjustment device are linked by the second pull line; the shift arm and the cushion back-and-forth moving device are linked by the third pull line;

wherein the chassis further comprises a rotating shaft, a first spring, and a spring rotating base, the spring rotating base defines a sliding groove and has an axis, the spring is coiled around the rotating shaft in a ring manner and is positioned in the spring rotating base, and two ends of the rotating shaft are fixedly connected with the left and right connecting rod of the seat backrest frame; first and second racks are provided in the chassis base and meshed with each other; wherein one end of the first rack is positioned in the sliding groove, and another end thereof presses against a second spring; the second rack slides in the chassis base so as to be meshed with or separated from the first rack, and is connected with the shift arm by the first pulling line; one exposed head of the second spring presses against a cavity wall of the spring rotating base, and another exposed head thereof presses against a slide block which moves up and down; the slide block is threadably connected with a screw; and a top part of the screw is provided with a turntable which is connected with one end of a rotatable handle by bevels.

6. The structure-improved multifunction chassis of claim 5, wherein two first springs are coiled around the rotating shaft in a ring manner symmetrically.

7. The structure-improved multifunction chassis of claim 4, wherein two ends of the chassis base are pivotally connected with the left and right connecting rod of the seat backrest frame respectively, the slide pedestal is located above the left and right connecting rod of the seat backrest frame.

* * * * *